US011591872B2

(12) United States Patent
Robertson et al.

(10) Patent No.: US 11,591,872 B2
(45) Date of Patent: Feb. 28, 2023

(54) SETTING TOOL FOR DOWNHOLE APPLICATIONS

(71) Applicant: Robertson Intellectual Properties, LLC, Arlington, TX (US)

(72) Inventors: Michael C. Robertson, Arlington, TX (US); Douglas J. Streibich, Fort Worth, TX (US); Antony F. Grattan, Mansfield, TX (US); Roy L. Sparkman, Haltom City, TX (US); Mark Lancaster, Alvarado, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 67 days.

(21) Appl. No.: 17/157,750

(22) Filed: Jan. 25, 2021

(65) Prior Publication Data

US 2021/0164308 A1 Jun. 3, 2021

Related U.S. Application Data

(63) Continuation-in-part of application No. 16/371,981, filed on Apr. 1, 2019, now Pat. No. 10,900,309, which is a continuation of application No. 14/930,369, filed on Nov. 2, 2015, now Pat. No. 10,246,961, which is a continuation-in-part of application No. 13/507,732, filed on Jul. 24, 2012, now Pat. No. 9,863,235.

(60) Provisional application No. 62/073,704, filed on Oct. 31, 2014.

(51) Int. Cl.

| | |
|---|---|
| ***E21B 23/06*** | (2006.01) |
| ***C06D 5/06*** | (2006.01) |
| ***C06B 33/02*** | (2006.01) |

(52) U.S. Cl.

CPC ..... *E21B 23/06* (2013.01); *C06B 33/02* (2013.01); *C06D 5/06* (2013.01); *E21B 23/065* (2013.01)

(58) Field of Classification Search

CPC ..... E21B 23/06; E21B 23/065; C06B 33/02; C06D 5/06

See application file for complete search history.

(56) References Cited

U.S. PATENT DOCUMENTS

| | | | |
|---|---|---|---|
| 1,614,840 | A | 1/1927 | Jones |
| 1,677,507 | A | 7/1928 | Vock et al. |
| 2,204,091 | A | 6/1940 | Lowrey |
| 2,380,022 | A | 7/1945 | Burt |

(Continued)

*Primary Examiner* — Aaron L Lembo

(74) *Attorney, Agent, or Firm* — McCutcheon Joseph, PLLC

(57) ABSTRACT

A setting tool having a tool body, a chamber configured to contain a non-explosive fuel configured to generate gas and plasma, a cavity, a bleed sub located between the chamber and the cavity. The bleed sub is configured to bleed pressure from the chamber to the cavity after the non-explosive fuel has been initiated. The setting tool also includes a piston disposed within the cavity oriented to stroke in a first direction after the non-explosive fuel has been initiated. The piston may divide the cavity into an upper volume that may receive the pressure increase from the bleed sub and a lower volume. The setting tool may also include a shaft mechanically connected to the piston within the lower volume of the cavity. The shaft may include a dampening conduit configured to drain a fluid from the lower volume after the non-explosive fuel has been initiated.

19 Claims, 10 Drawing Sheets

(56) References Cited

U.S. PATENT DOCUMENTS 2,692,648 A 10/1954 Simmons
2,741,316 A 4/1956 Long
2,862,564 A 12/1958 Bostock
3,019,842 A 2/1962 Nutter
3,175,617 A 3/1965 North
3,244,232 A * 4/1966 Myers ..... E21B 23/065 166/212
3,344,862 A 10/1967 Conrad
3,355,192 A 11/1967 Kloesel, Jr. et al.
3,419,079 A 12/1968 Current
3,420,304 A 1/1969 Kilgore
4,108,243 A 8/1978 King et al.
4,369,840 A 1/1983 Szarka et al.
4,466,497 A 8/1984 Soinski et al.
4,510,995 A 4/1985 Krause, Jr. et al.
4,570,707 A 2/1986 Setterberg, Jr.
4,688,641 A 8/1987 Knieriemen
5,352,308 A 10/1994 Tomihara et al.
5,390,735 A 2/1995 Williamson, Jr.
5,396,951 A * 3/1995 Ross ..... E21B 23/065 166/63
5,720,344 A 2/1998 Newman
5,803,176 A 9/1998 Blizzard, Jr.
5,984,007 A 11/1999 Yuan
6,012,527 A 1/2000 Nitis et al.
6,199,632 B1 3/2001 Shy
6,631,768 B2 10/2003 Patel et al.
6,761,217 B1 7/2004 McGarian
6,929,063 B2 8/2005 Reese et al.
7,000,704 B2 2/2006 Smith
7,506,700 B1 3/2009 Harvey et al.
7,591,319 B2 9/2009 Xu
7,640,975 B2 1/2010 Cavender et al.
7,669,661 B2 3/2010 Johnson
7,726,392 B1 6/2010 Robertson
7,814,978 B2 * 10/2010 Steele ..... E21B 43/26 166/212
7,828,052 B2 11/2010 Obrejanu
8,196,515 B2 6/2012 Streibich
8,474,381 B2 7/2013 Streibich
8,534,367 B2 9/2013 Carisella
8,616,293 B2 12/2013 Robertson et al.
8,752,486 B2 6/2014 Robertson
8,893,786 B2 11/2014 Wright
9,234,412 B2 1/2016 Getzlaf et al.
9,580,975 B2 2/2017 Carlsen et al.
2003/0173089 A1 9/2003 Westgard et al.
2005/0247450 A1 * 11/2005 Ratanasirigulchai ... E21B 35/00 166/378
2007/0246211 A1 10/2007 Schneider
2011/0132223 A1 * 6/2011 Streibich ..... E21B 23/065 102/531
2011/0174504 A1 6/2011 Wright
2012/0216701 A1 8/2012 Streibich
2013/0068451 A1 * 3/2013 Getzlaf ..... E21B 47/06 166/305.1
2014/0137761 A1 5/2014 Robertson
2016/0130903 A1 5/2016 Robertson
2016/0168936 A1 6/2016 Carisella
2016/0369597 A1 12/2016 Robertson
2017/0067305 A1 3/2017 Robertson

* cited by examiner

SETTING TOOL FOR DOWNHOLE APPLICATIONS

CROSS REFERENCE TO RELATED APPLICATIONS

The present application is a continuation-in-part of, and claims priority to, U.S. patent application Ser. No. 16/371,981, having a title of "Setting Tool For Downhole Applications, filed Apr. 1, 2019, which claims priority to "U.S. patent application Ser. No. 14/930,369, now U.S. Pat. No. 10,246,961, having a title of "Setting Tool For Downhole Applications, filed Nov. 2, 2015, which claims priority to U.S. Provisional Application Ser. No. 62/073,704, having a title of "Setting Tool For Downhole Applications, filed Oct. 31, 2014 and is a continuation-in-part of U.S. patent application Ser. No. 13/507,732, now U.S. Pat. No. 9,863,235, having a title of "Permanent Or Removable Positioning Apparatus And Methods For Downhole Tool Operations," filed Jul. 24, 2012, all of which are incorporated, in their entireties, by reference herein.

FIELD OF THE INVENTION

The present invention relates, generally, to the field of downhole tools and methods of setting such downhole tools within a well bore. More particularly, the embodiments of the present invention relate to a non-explosive, gas-generating setting tool usable for downhole applications.

BACKGROUND

Many wellbore operations necessitate anchoring a tool within the wellbore. Such tools can include plugs, packers, hangers, casing patches, and the like (collectively referred to herein as downhole tools).

Downhole tools must be deployed within a wellbore using a setting tool. (Note the distinction between the term "setting tool" and the term "downhole tool." As used herein, a "setting tool" refers to a tool that is used to deploy a "downhole tool" within a wellbore). The setting tool carries the downhole tool to the desired location within the wellbore and also actuates mechanisms that anchor the downhole tool within the wellbore. To deploy a downhole tool within a wellbore, a setting tool is typically connected to the downhole tool and the pair of tools (i.e., setting tool and downhole tool) is run down the wellbore using a slickline, coiled tubing, or other conveying method. Once the pair of tools reaches the desired depth within the wellbore, the setting tool deploys the downhole tool.

A variety of types of setting tools that operate according to a variety of designs are known in the art. Setting tools differ from one another with regard to the method by which they produce the output needed to actuate the downhole tools and, consequently, the amount of force they are capable of producing. Examples of force generating methods include hydraulic, electromechanical, mechanical, and pyrotechnic (explosive) methods. Each type of setting tool has associated advantages and disadvantages. For example, a disadvantage of hydraulic setting tools is that they generally require that fluid be pumped to the tool from the surface to pressurize and actuate the tool's setting mechanisms. By contrast, a pyrotechnic-based setting tool may be actuated using a timer or condition sensor that is contained within the setting tool itself, allowing the setting tool to operate without communicating with the surface to activate the setting tool. Examples of condition sensors include sensors that monitor acceleration, hydrostatic pressure, temperature, or a combination of these or other conditions. Once the requisite programmed conditions are met, a detonator within the setting tool can activate, and deploy the downhole tool, without needing to receive instructions from the surface.

Pyrotechnic-based setting tools have several problems. One problem is that the highly explosive materials they require to operate are generally dangerous and are typically subject to import/export and travel restrictions. Also, the setting tool can remain pressurized following detonation and must be depressurized by bleeding off pressure from the tool, by rupturing a bleed off mechanism at the surface—an operation that can be hazardous. Still further, and as explained in more detail below, pyrotechnic-type setting tools produce pressure in an explosive manner. The impulse generated by the rapid expansion of gases upon detonation in such a setting tool may not generate the optimum pressure for deploying downhole tools. Basically, the explosion may generate too much overpressure, over too short of a time, to properly set the downhole tool. Consequently, the force of the explosion must be throttled or dampened—a function typically performed using an internal hydraulic transducing mechanism. But such tools are limited in their application because they can only produce adequate force over short distances.

Accordingly, there remains a need in the art for a more versatile setting tool.

SUMMARY

The present invention relates to a non-explosive, gas-generating setting tool usable for setting downhole tools, such as a include a packer, a bridge plug, a fracturing plug, or other similar downhole tools, within a well bore.

In an embodiment, a setting tool may include a tool body coupled to a well tool that can be configured to be deployed downhole within a well, and a chamber within the tool body that can be configured to contain a non-explosive fuel, which can be configured to be initiated to generate gas and plasma. In the embodiment, the setting tool can also include a cavity within the tool body, a bleed sub located within the tool body between the chamber and the cavity, wherein the bleed sub is configured to bleed pressure from the chamber to the cavity after the non-explosive fuel has been initiated, and a piston disposed within the cavity and oriented to stroke in a first direction in response to a pressure increase in the cavity after the non-explosive fuel has been initiated. The piston can divide the cavity into an upper volume and a lower volume, and the upper volume can receive the pressure increase from the bleed sub. Further, the setting tool can include a shaft mechanically connected to the piston within the lower volume of the cavity. The shaft can include a dampening conduit that can be configured to drain a fluid from the lower volume after the non-explosive fuel has been initiated.

In certain embodiments, the dampening conduit is configured to drain the fluid to a location that is external to the tool body. The fluid that drains from the lower volume may have a higher viscosity, e.g., the fluid can be oil, an oil derivative, or a synthetic lubricant, that flows more slowly than a less viscose fluid through the dampening conduit. A fluid having a higher viscosity, such as oil, an oil derivative, or a synthetic lubricant, can enhance the control of the stroke of the piston, which in turn can produce a more precise actuating force on the downhole tool. In some embodiments, the fluid may be at least one of non-flammable, not-toxic, and non-corrosive. In an embodiment, the higher viscosity fluid may reduce the rate of travel of the piston during the piston stroke to be within a range of 0.25 inches per second to 10 inches per second. In an embodiment, the dampening conduit comprises an inlet hole and an outlet hole that are adjustable or customizable to change the flow of the fluid through the dampening conduit.

In certain embodiments, the dampening conduit can include an inlet hole in the shaft that is between 1 cm (0.39 inches) and 3 cm (1.18 inches) from the piston. The setting tool may further include a snubber within the tool body configured to decelerate the piston and the shaft.

In certain embodiments, the dampening conduit can be shaped to slow the flow of the fluid, and to slow the stroke of the piston in the first direction. And the tool body can include a first inside diameter, with one or more o-rings disposed upon the piston to form a gas-tight seal between the piston and the first inside diameter.

In certain embodiments, the setting tool can include a second inside diameter longitudinally disposed with respect to the first inside diameter, the second inside diameter may be greater than the first inside diameter. Also, the piston may stroke in the first direction from the first inside diameter to the second inside diameter, where the one or more o-rings do not form a gas-tight seal between the piston and the second inside diameter.

The disclosed embodiments include a method of setting a setting tool. The method can include the steps of activating a power source to generate a source of expanding gases within a first cavity, expanding the expanding gases through a bleed sub to a second cavity, stroking a piston through the second cavity with the expanding gases, and decelerating the piston before the piston completes a stroke length.

In certain embodiments, the method can include bleeding the expanding gases to an external area of the setting tool. Bleeding the expanding gases may include releasing a gas-tight seal between the piston and an inner diameter of the setting tool.

In certain embodiments, the method can include setting a downhole tool such as a packer, a bridge plug, a fracturing plug, or combinations thereof.

In certain embodiments, setting the setting tool can include filtering the expanding gases through a filtering plug. The filtering plug can be configured to filter solid particulates that are produced by the power source. The method may also include stroking the piston to push a crosslink key with a shaft. In further embodiments, decelerating the piston can include deforming a snubber, or forcing fluid through a dampening conduit within a shaft of the setting tool. In such embodiments, the shaft can be attached to, and stroke with, the piston.

BRIEF DESCRIPTION OF THE DRAWINGS

FIGS. 3C to 3F illustrate further views of the non-explosive gas-generating setting tool shown in FIGS. 3A and 3B, wherein FIG. 3D is an enlarged view of a portion of FIG. 3C, and FIG. 3F is an enlarged view of a portion of FIG. 3E.

DESCRIPTION

Before describing selected embodiments of the present disclosure in detail, it is to be understood that the present invention is not limited to the particular embodiments described herein. The disclosure and description herein is illustrative and explanatory of one or more presently embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
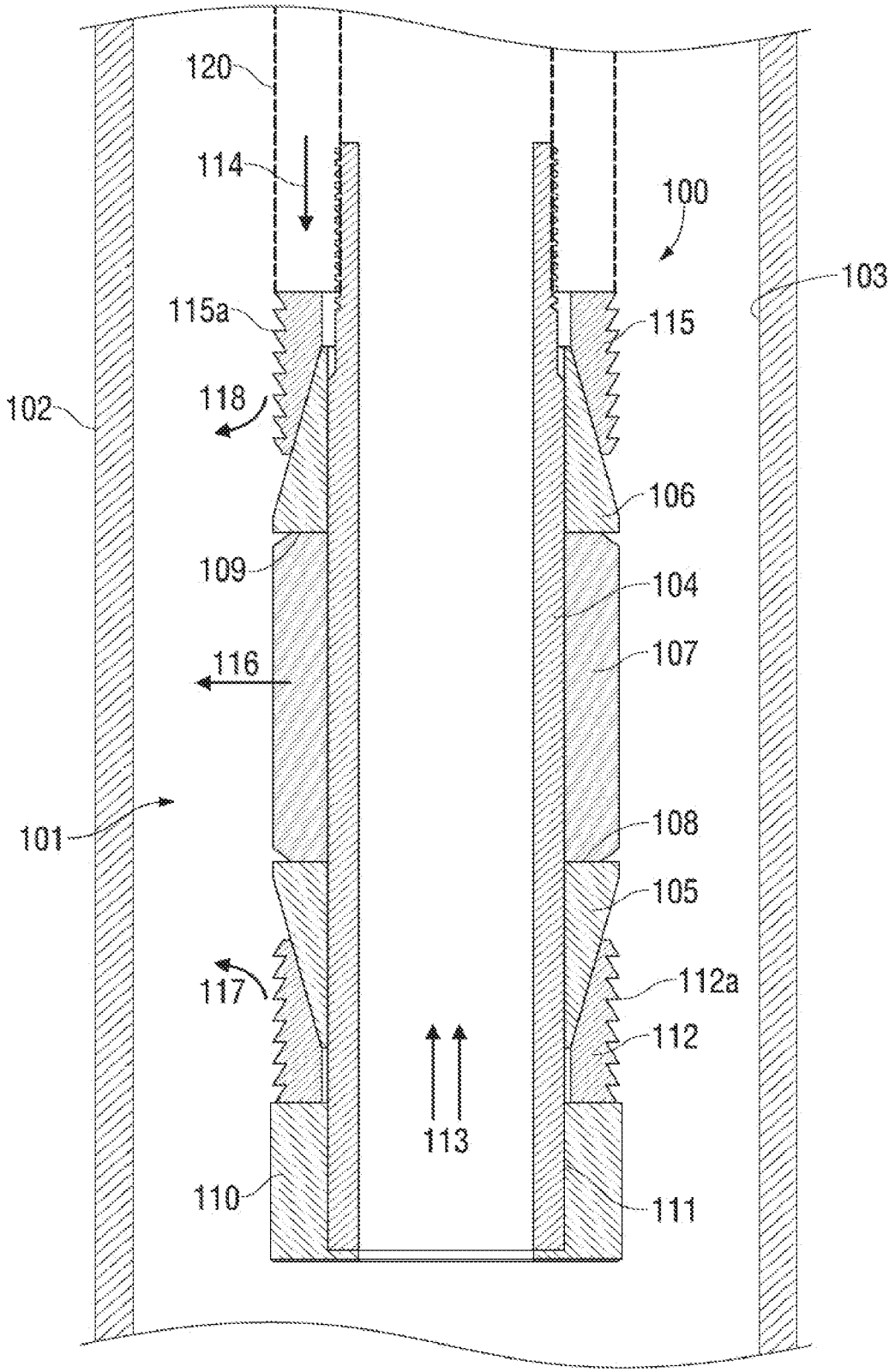
FIG. 1 illustrates a downhole tool according to an embodiment.

FIG. 1 illustrates a mechanism for anchoring a downhole tool 100 in a wellbore 101. Wellbore 101 includes a tubular member 102 having an inner diameter (ID) 103. Tubular member 102 may be production tubing, casing, production liner or any other structure defining the walls of a wellbore. Wellbore 101 is illustrated as being substantially larger in diameter than downhole tool 100, but this is for illustration purposes only. Generally, the downhole tool 101 would have a diameter only slightly smaller than ID 103 of tubular member 102.

Downhole tool 100 includes a mandrel 104 having cone-shaped protrusions 105 and 106 and a sealing section 107. Cone-shaped protrusions 105 and 106 can slide over the mandrel 104 and make contact with sealing section 107 via surfaces 108 and 109, respectively. Sealing section 107 is typically made of a deformable or otherwise malleable material, such as plastic, metal, an elastomer or the like.

Downhole tool 100 further includes a base section 110 attached to the mandrel 104 via a threaded section 111. Base section 110 can apply pressure to cone-shaped protrusion 105 via slips 112 when the mandrel 104 is moved in an upward direction 113. Cone-shaped protrusion 105 consequently slides up and over the mandrel 104, applying pressure to the sealing section 107. Downward pressure 114 to slips 115 (usually exerted by a sleeve 120) likewise transfers pressure to the sealing member 107 as the cone-shaped protrusion 106 slides downward. Sealing member 107 deforms and expands due to lateral pressure 116 (with force line indicated), as the sealing member 107 is squeezed between the cone-shaped protrusions 105 and 106. Ultimately, the sealing member expands to form a seal with the ID 103 of tubular member 102.

Once the lateral pressure 116 of the sealing member 107 against the ID 103 exceeds a certain calibrated value, continued squeezing (i.e., 113 and 114) causes the slips 112 and 115 to ride up on the cone-shaped protrusions 105 and 106, respectively. Slips 112 and 115 are also commonly referred to in the art as "dogs." Upwardly stroking of the bottom dog (i.e., slip 112) causes the dog to ride up the cone-shaped protrusion 105 and to deform outwardly, indicated by the illustrated force arrow 117. Ultimately, the dog (i.e., slip) 112 will deform outwardly enough that the teeth 112*a* of the dog (i.e., slip) will bite into the ID 103. Likewise, continued downward pressure 114 on the slip 115 will cause the slip 115 to deform outwardly (indicated by the illustrated force arrow 118). Thus, downwardly stroking the top dog (top slip 115) causes the top dog to bite into the ID 103 with teeth 115*a*. In the deployed configuration, the downhole tool 100 is anchored within the wellbore 101 by lateral pressure of the sealing section 107 and by the friction of the slips 112 and 115 biting into the ID 103 (via teeth 112*a* and 115*a*, respectively).

Figure 2:
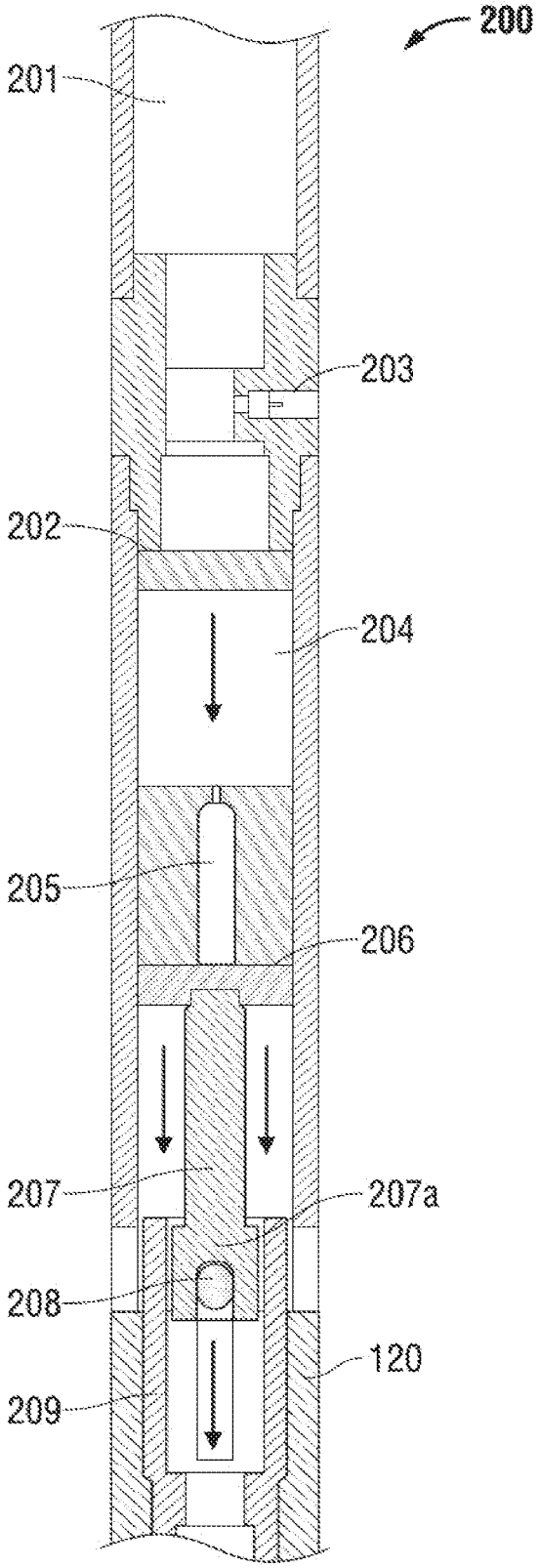
FIG. 2 illustrates an embodiment of an explosive-based setting tool.

FIG. 2 illustrates a pyrotechnic-based setting tool 200. Note that the purpose of FIG. 2 is to illustrate how an explosive-based setting tool 200 operates and not to provide a comprehensive disclosure of that type of setting tool. As such, details of the actual tool construction, for example, o-rings, connectors, seals and the like, are omitted for clarity.

Pyrotechnic-based setting tool 200 includes a pressure chamber 201 that is in gas communication with a top piston 202. Pressure chamber 201 is configured to contain an explosive power charge that provides the power that drives piston 202 of the setting tool 200. The explosive power charge is typically ignited using an igniter contained in an isolation sub disposed upward of the pressure chamber 201. Pressure chamber 201 is typically configured with a bleed off valve 203 for bleeding off gases after the tool has been used and is returned to the surface of the wellbore.

Upon ignition, rapidly expanding gases exert pressure on the top piston 202, which in turn compresses hydraulic fluid that is contained within reservoir 204. The pressurized hydraulic fluid, which is choked somewhat by a cylindrical connector 205, applies pressure to a bottom piston 206. As the bottom piston is pressurized, it moves in a downhole direction, bringing with it a piston rod 207. Head 207*a* of the piston rod 207 is configured with a crosslink key 208. As the piston rod 207 strokes downward, the crosslink key 208 engages and pushes a sleeve 120 that is configured upon a setting mandrel 209. Although not shown, the setting mandrel 209 can be temporarily affixed to the mandrel 104 of the downhole tool 101, typically via a shear pin. The sleeve 120 applies downward pressure 114 to the slips 115 of the downhole tool 100 (not shown here, but depicted in FIG. 1), while affixation of the mandrels 209 and 104 creates an equal upward pressure 113 to the slips 112. This actuates the setting mechanism of the downhole tool, as described earlier. Once the tool 100 is set in the tubular member 102, tools 200 and 100 can be decoupled (typically by shearing the shear pin that holds them together), leaving the downhole tool 100 in place.

As mentioned previously, the rapid expansion of gases and pressurization within the setting tool upon detonation requires that the generated pressure be throttled back and applied to the actuating mechanism (i.e., piston rod 207) in a controlled manner. That throttling function is performed by the hydraulic system, shown schematically as reservoir 204 and the cylindrical connector 205 of the setting tool 200 in a controlled manner.

The inventors have discovered that by using a non-explosive gas-generating material as the power source, the benefits of a pyrotechnic-type setting tool can be realized, but without the associated drawbacks. Namely, the setting tool described herein does not require a hydraulic damping system to transfer power from the power source to the actuating mechanism. Also, the non-explosive gas-generating material is safer to handle and transport and generally does not require the same shipping and import/export controls as do the explosive materials used with pyrotechnic-type setting tools. Easier transporting and shipping requirement is valuable; it can result in a setting tool being available at a well-site within a day or two, as opposed to within a week or two—a difference that can equate to hundreds of thousands of dollars to the well owner.

Figure 3A:
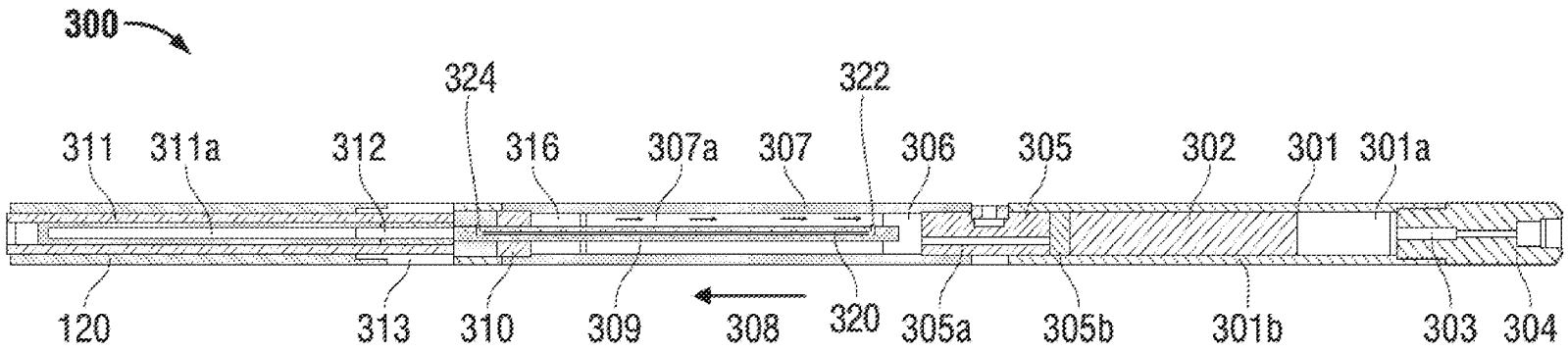
FIGS. 3A and 3B illustrate an embodiment of a non-explosive gas-generating setting tool in the pre-function and post-function configuration, respectively.
Figure 3B:
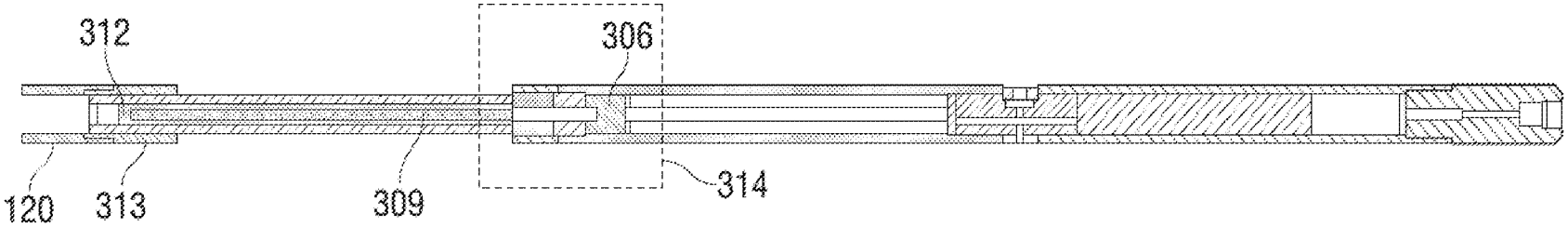
Figure 3C:
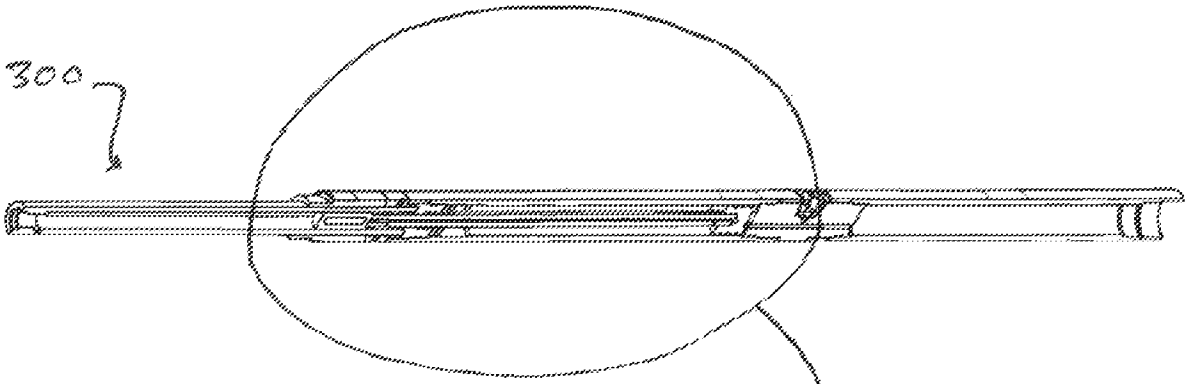
Figure 3D:
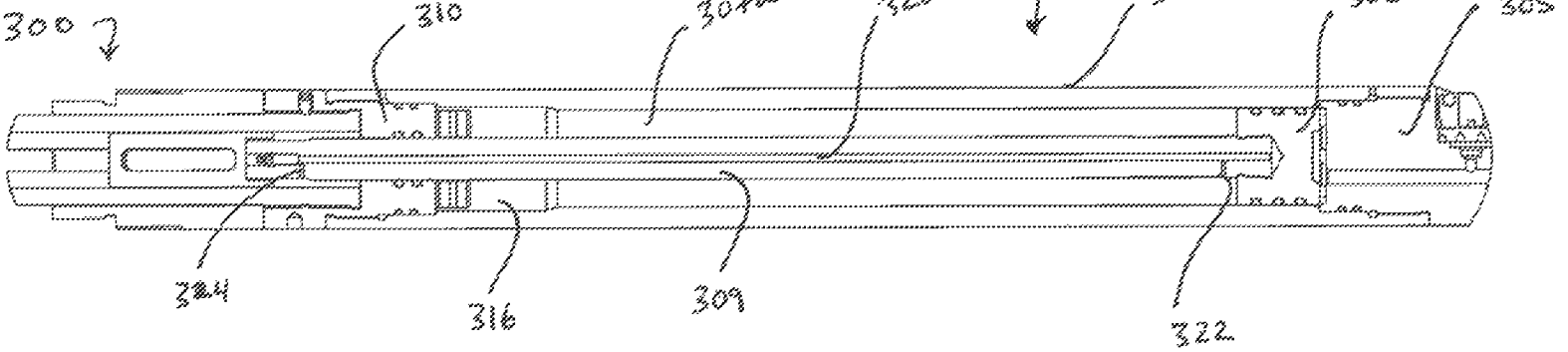
Figure 3E:
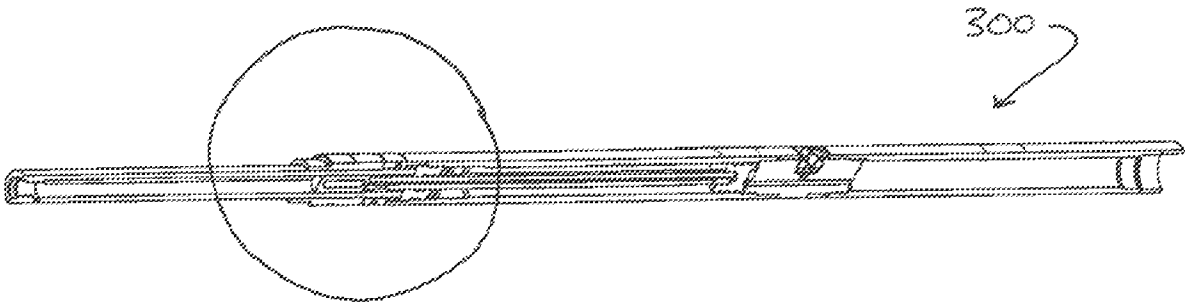
Figure 3F:
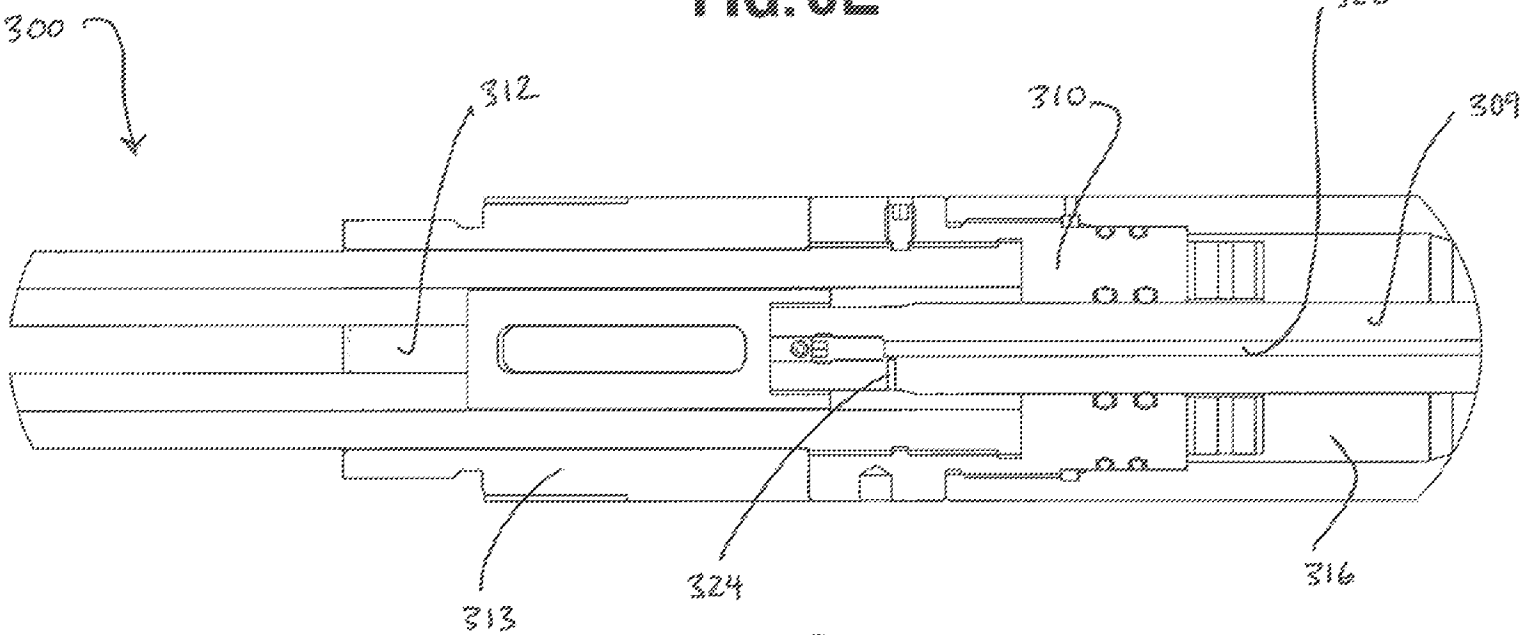

FIGS. 3A and 3B illustrate an embodiment of a non-explosive gas-generating setting tool 300 in the pre-function and post-function configuration, respectively. FIGS. 3C to 3F illustrate further views of the non-explosive gas-generating setting tool shown in FIGS. 3A and 3B. FIG. 3D is an enlarged view of a portion of FIG. 3C, and FIG. 3F is an enlarged view of a portion of FIG. 3E. For purposes of clarity, some elements of the non-explosive gas-generating setting tool 300 that are labeled in FIG. 3A are not re-labeled in FIGS. 3B to 3F.

Non-explosive gas-generating setting tool 300 includes a power source body 301 that contains a power source 302. Power source 302 is capable of producing gas in an amount and at a rate sufficient to operate the non-explosive gas-generating setting tool 300. Power source 302 is referred to as an "in situ" power source, meaning that it is contained within the setting tool downhole during operation. The in situ power source can be activated from the surface, via wireline, for example, or can be activated using a timer or sensor downhole.

As used herein, the term "power source" refers to a non-explosive gas-generating source of gas. Examples of suitable power source materials and construction are described in U.S. Pat. No. 8,474,381, issued Jul. 2, 2013, the entire contents of which are hereby incorporated herein by reference. Power source materials typically utilize thermite or a modified thermite mixture. The thermite or thermite mixture can include a metal and an oxidizer. In one embodiment, the combination of the metal and the oxidizer can form a product comprising a metal oxide. The metal can be aluminum, magnesium, etc. The oxidizer can include cupric oxide, iron oxide, ammonium perchlorate, etc. A particular example of a thermite mixture can be aluminum and cupric oxide. When ignited, the flammable material produces an exothermic reaction. The material may also contain one or more gasifying compounds, such as one or more hydrocarbon or fluorocarbon compounds, particularly polymers.

Power source 302 can be activated (ignited) using an activator 303 contained within an isolation sub 304. Examples of suitable activators include Series 100/200/300/

700 Thermal Generators™ available from MCR Oil Tools, LLC, located in Arlington, Tex.

Once activated, the power source 302 generates gas, which can expand and fill a chamber 301*a* of the power source body 301. The chamber 301*a* may be protected by a coating or liner 301*b* that is resistant to high temperatures that the power source 302 may reach as the gas expands. The liner 301*b* can include a ceramic coating that is painted into the chamber 301*a* during manufacture. The liner 301*b* may also include a carbon sleeve into which the power source 302 can be inserted as the setting tool 300 is prepared for operation at the surface of the well. The liner 301*b* can include other materials, such as PVC, plastic, polymers, and rubber. The liner 301*b* enables a broader range of materials to be used for construction of the power source body 301. For example, without the liner 301*b*, the power source body 301 would be restricted to materials that did not corrode, melt, or otherwise react with the power source 302 and the resulting high temperature gases.

The gas expands via a conduit 305*a* of a bleed sub 305 and can apply pressure to a piston 306, which is contained within a tool body 307. Specifically, the piston 306 is contained within a cavity 307*a* of the tool body 307, and divides the tool body into a upper volume and a lower volume. The upper volume receives pressure from the bleed sub and pushes the piston 306 in a direction 308 toward the lower volume. To protect the conduit 305*a*, the power source body 301 may also include a filtering plug 305*b* to filter the expanding gases from the solid particulates that are also produced by the power source 302. When the power source 302 is activated, the solid fuel is rapidly transformed into gases that power a reaction, as explained in detail below. In addition to these gases, however, the power source 302 can include hot plasma or solids that can burn or otherwise damage the components of the setting tool 300. The filtering plug 305*b* can comprise a graphite disk or block, having a number of holes that are sized to allow gases to pass through without allowing the plasma or solids to pass through. The gases that are allowed to pass through are not as damaging to the bleed sub 305 or the tool body 307 as the plasma or burning solids.

Under pressure produced by the expansion of gases from the power source 302, the piston 306 moves (i.e. strokes) in the direction indicated by arrow 308. As piston 306 moves, it pushes a shaft 309, which is connected to the tool body 307 via a shaft sub 310. The shaft 309 strokes within a mandrel 311, pushing a crosslink key 312 that is set in a slot 311*a* within the mandrel 311. Crosslink key 312 is configured to engage a crosslink adapter 313 and an extension sleeve 120. The crosslink key 312 pushes the crosslink adapter 313 and the extension sleeve 120, causing the sleeve to apply the actuating force (113, 114) to deploy a downhole tool. Piston 306, shaft 309, crosslink key 312 and sleeve 120 are therefore a power transfer system that delivers force generated by the combustion of the power source 302 to actuate/deploy a downhole tool.

Embodiments of non-explosive gas-generating setting tool 300 may include components to decelerate the piston 306 before contacting the shaft sub 310. For example, the setting tool 300 can include a snubber 316, which is a compressible member configured to be impacted by the piston 306 as the piston completes its stroke, thereby decelerating the piston stroke and dissipating energy from the piston and shaft. Snubber 316 is configured upon the shaft 309 and within tool body 307 and is made of a compressible material, for example, a polymer, plastic, PEEK™, Viton™, or a crushable metal, such as aluminum, brass, etc. The controlled deformation of snubber 316 decelerates the moving piston 306 and shaft 309, absorbing energy in the traveling sub assembly and preventing damage due to rapid deceleration. The material of the snubber 316 may be chosen to adjust the deceleration and provide differing values of energy damping based on tools size, setting force, etc. Should additional damping be required, the cavity 307*a* within the tool body 307 can be pressurized with a secondary gas to provide additional resistance to the motion of the piston 306. Accordingly, the tool body 307 may be fitted with a valve (not shown) for introducing such pressurized gas.

To further decelerate movement of the piston 306, or to slow acceleration in the first place, the setting tool 300 may include a dampening conduit 320. The dampening conduit 320 can include an inlet hole 322 and an outlet hole 324 that fluidly connect the lower volume of the cavity 307*a* to the outside (e.g., an external area) of the tool body 307. The lower volume of the cavity 307*a* may then be filled with a fluid (e.g., liquid or gas) that flows through the dampening conduit 320 as the piston 306 strokes in the downward direction 308. Specifically, as the piston 306 strokes, the upper volume (between the piston 306 and the bleed sub 305) increases in volume, while the lower volume (between the piston 306 and the snubber 316, or the piston 306 and the shaft sub 310) decreases in volume. The decrease in the lower volume increases the pressure in the lower volume and forces the fluid through the dampening conduit 320.

The fluid and the dampening conduit 320 may be designed, configured, or shaped to provide a certain amount of dampening. For example, the fluid within the lower volume may include a liquid with a high viscosity, such that flow through the dampening conduit 320 is slow. Such fluids may include oil, an oil derivative, or a synthetic lubricant. One example of a synthetic lubricant that may be used is ECOCOOL®, by Fuchs Lubricants Co., U.S.A. The fluid may possess beneficial wellbore qualities, such as being non-flammable, not-toxic, and/or non-corrosive, etc. Furthermore, the particular viscose fluid to be used in the dampening conduit 320 may be selected based on conditions of the wellbore, such as well temperature and wellbore pressure. A highly viscose fluid may enable a more controlled stroke of the piston 306, which in turn enables a more precise actuating force on the downhole tool 100. The higher viscosity fluid slows down the piston's rate of travel during the piston stroke to a desirable rate. For instance, the higher viscosity fluid may reduce the rate of travel of the piston 306 during the piston stroke to be within a range of 0.25 inches per second to 10 inches per second (with 0.25 inches per second and 10 inches per second being included within the range). In one example, the rate of travel of the piston 306 may be reduced to 1 inch per second. However, reduced rates of travel greater than 10 inches per second are within the scope of this disclosure, so long as they are much lower than conventional rates, such as 500 inches per second, of travel for the piston during the piston stroke. For instance traveling rates included within the range of 10 inches per second to 50 inches per second may be envisioned within the scope of this disclosure. The location, size, shape, or configuration of the inlet hole 322 and the outlet hole 324 can be customized to adjust the flow of the fluid through the dampening conduit 320.

As shown, the non-explosive gas-generating setting tool 300 is mechanically linked with the piston 306 (i.e., the piston directly activated by pressurization of power source body 301) and the extension sleeve that ultimately deploys the downhole tool. In other words, there is not an intervening hydraulic or pneumatic stage. Stroking of the piston 306 and shaft 309 mechanically actuates the extension sleeve by pushing one or more rigid members (i.e., crosslink key 312 and crosslink adapter 313).

In addition, embodiments of non-explosive gas-generating setting tool 300 can include just a single piston/shaft, with the shaft being mechanically connected to the piston. As such, the non-explosive gas-generating setting tool 300 does not require multiple pistons (202, 206) to achieve a long stroke length. As used herein, the term stroke length refers to the length over which useful force can be applied, as explained in more detail below.

Non-explosive gas-generating setting tool 300 features two mechanisms for bleeding off gases that are generated during the ignition of the power source 302. The first bleed off feature 314, is referred to herein as a self-bleed feature and is illustrated in greater detail in FIG. 4. The second bleed off feature is provided by the bleed sub 305 and is illustrated in more detail in FIG. 5, discussed below.

Figure 4:
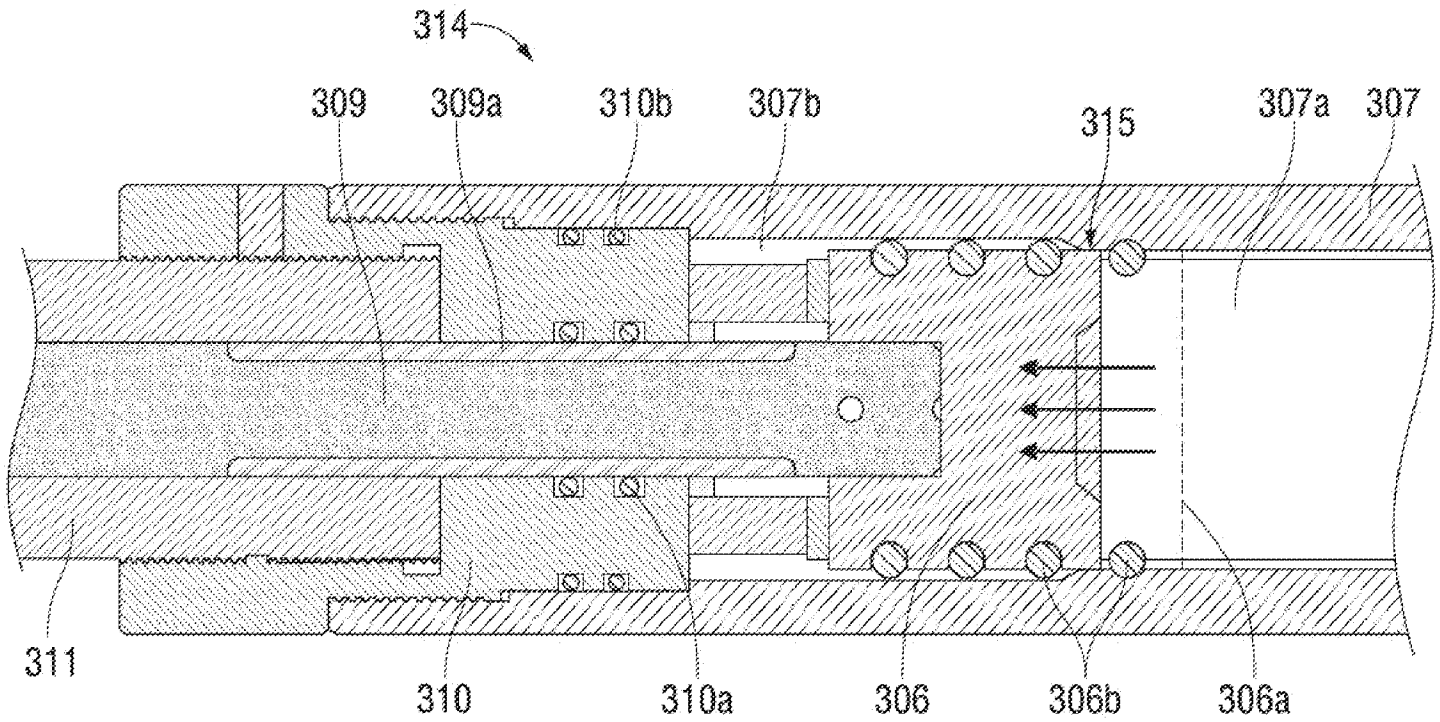
FIG. 4 illustrates an embodiment of a self-bleed mechanism for a non-explosive gas-generating setting tool.

Referring to FIG. 4, dashed line 306*a* represents the position of the piston 306 before it has completed its stroke. In this intermediate position, piston o-rings (illustrated as hatched o-rings 306*b*) can form a gas-tight seal with the inner diameter (ID) of the tool body 307. The ID of tool body 307 can be configured with a spacer 307*b* between its ID and the piston 306 once the piston 306 has completed its stroke. Because of the spacer 307*b*, the piston o-rings 306*b* do not form a gas-tight seal with the ID of the tool body 307 once the piston stroke is completed, as FIG. 4 shows. Instead, the area of contact 315 between the piston 306 and the ID of the tool body 307 allows gas to pass between the chamber 307*a* and the spacer 307*b*. Stated slightly differently, as the piston 306 strokes within the tubular tool body 307, the piston travels from a section the of tool body having a smaller ID into a section of the tool body 307 having a larger ID. When the piston 306 is within the section with the smaller ID, the o-rings are capable of forming a gas-tight seal between the piston and the ID. But when the piston 306 is within the section with the larger ID, the o-rings 306*b* are not capable of forming such a gas seal.

Shaft sub 310 also includes o-rings 310*a*, which are capable of forming a gas-tight seal between the shaft 309 and the shaft sub 310 along the initial majority of its length. However, the proximal end of the shaft 309 can be configured with a fluted section having flutes 309*a*, which prevent the shaft sub o-rings 310*a* from forming a gas-tight seal between the shaft sub 310 and the shaft 309 when the shaft 309 nears completion of its stroke. Thus, at the end of the stroke, gas overpressure within the chamber 307*a* has a conduit (i.e., an "escape route") by which to bleed into the wellbore by first escaping into the spacer 307*b* through the area of contact 315 and, then, into the wellbore through the flutes 309*a*.

Figure 5:
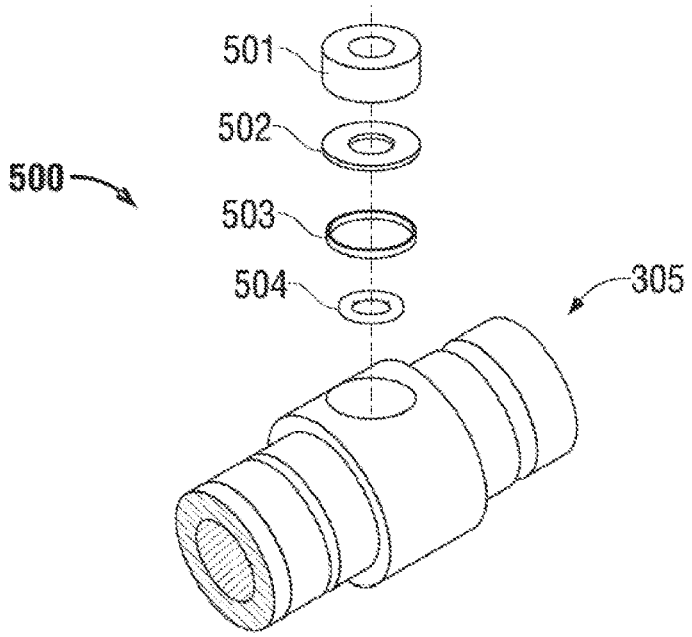
FIG. 5 illustrates an embodiment of a manual bleed sub for a non-explosive gas-generating setting tool.

FIG. 5 illustrates the bleed sub 305 and related sealing components 500, in detail. Manual bleed off mechanisms, such as the one illustrated in FIG. 5, are known in the art and generally include a nut 501, a pressure bleed off disk 502, and one or more o-rings or seals 503. However, bleed sub 305 includes an additional component—a carbon disk 504, to protect the sealing components 500 from gases generated during the activation of the power source. Should the self-bleed mechanism fail to adequately bleed off the pressurized gases, the bleed off disk 502 and the carbon disk 504 can be punctured to relieve the pressure in the setting tool once it is retrieved at the surface.

Figure 6:
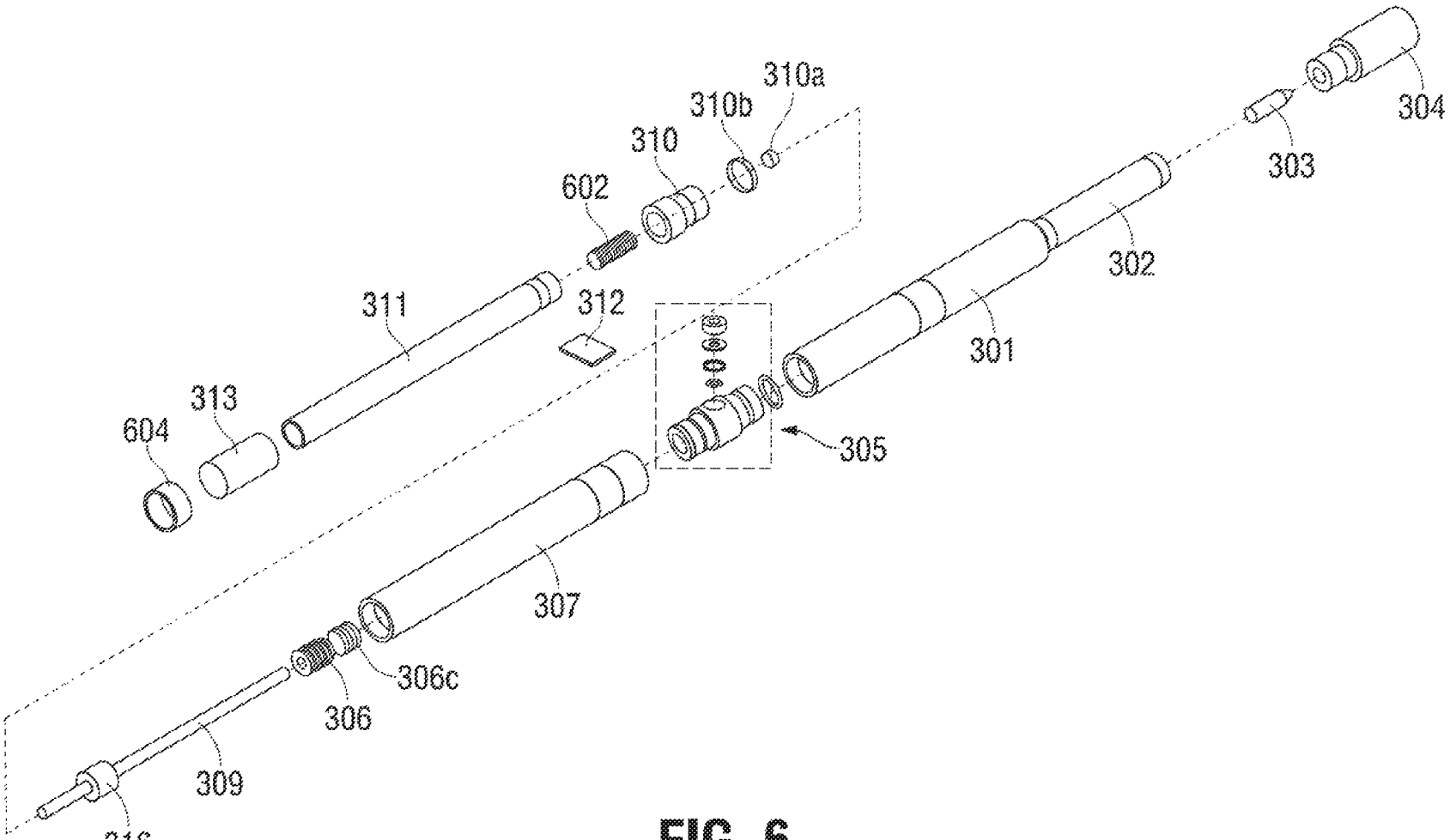
FIG. 6 is an exploded view of an embodiment of a non-explosive gas-generating setting tool.

FIG. 6 illustrates an exploded view of the non-explosive gas-generating setting tool 300, showing the interrelationship of the following components, which have been discussed above: power source body 301, power source 302, activator 303, isolation sub 304, bleed sub 305, piston 306, piston o-rings 306*c*, tool body 307, shaft 309, shaft sub 310, shaft sub o-rings 310*a* and 310*b*, mandrel 311, snubber 316, crosslink key 312, and crosslink adapter 313. Also shown in FIG. 6 are a crosslink coupler 602 and a crosslink retainer 604.

To deploy a downhole tool, such as the downhole tool 100 illustrated in FIG. 1, a setting tool must generate enough force and must provide a long enough stroke to actuate the setting mechanism of the downhole tool 100. Actuating the setting mechanism might include moving the cone-shaped protrusions 105 and 106, compressing and laterally expanding the sealing section 107, setting the slips 112 and 115 and shearing off a shear pin that attaches the downhole tool to the setting tool. The amount of force required to perform all of those tasks is referred to as shear force ($F_s$) because deploying a downhole tool typically culminates in shearing a shear pin to leave the tool in place. The stroke required to actuate the downhole tool is referred to as the required stroke length. The setting tool must also provide adequate force to overcome the hydrostatic pressure within the wellbore 101 at whatever depth within the wellbore the downhole tool is located.

Setting tools are often characterized according to their rated shear forces and stroke lengths. For example, an operator might need to deploy a downhole tool that requires a shear force of 9,000 kg (20,000 pounds) and a stroke length of 30 cm (12 inches). That operator would look for setting tool that is rated to provide 9,000 kg (20,000 pounds) of force at a stroke length of 30 cm (12 inches) at the particular hydrostatic pressure present at the depth within the wellbore the operator intends to deploy the tool. Standard rated stroke lengths may vary; examples values may comprise about 15, 30, 45, or 60 cm (6, 12, 18, or 24 inches). Rated shear forces may comprise about 9,000, 11,333, 13,500, 18,000, 22,500, 25,000 or 29,000 kg (20,000, 25,000, 30,000, 40,000, 50,000, 55,000, or 60,000 pounds, respectively). Setting tools may be rated at hydrostatic pressures comprising about, 15,000, 20,000, 25,000, 30,000, 35,000, or 40,000 psi (103 mPa, 138 mPa, 172 mPa, 207 mPa, 241 mPa, and 276 mPa, respectively). For example, a setting tool might be rated to provide 9,000 kg (20,000 pounds) of shear force at a 30 cm (12 inch) stroke length and at a hydrostatic pressure of 138 mPa (20,000 psi). That same tool might not reliably provide 9,000 kg (20,000 pounds) of shear force if the hydrostatic pressure were increased to 172 mPa (25,000 psi) or if the stroke length were increased to 45 cm (18 inches).

Figure 7:
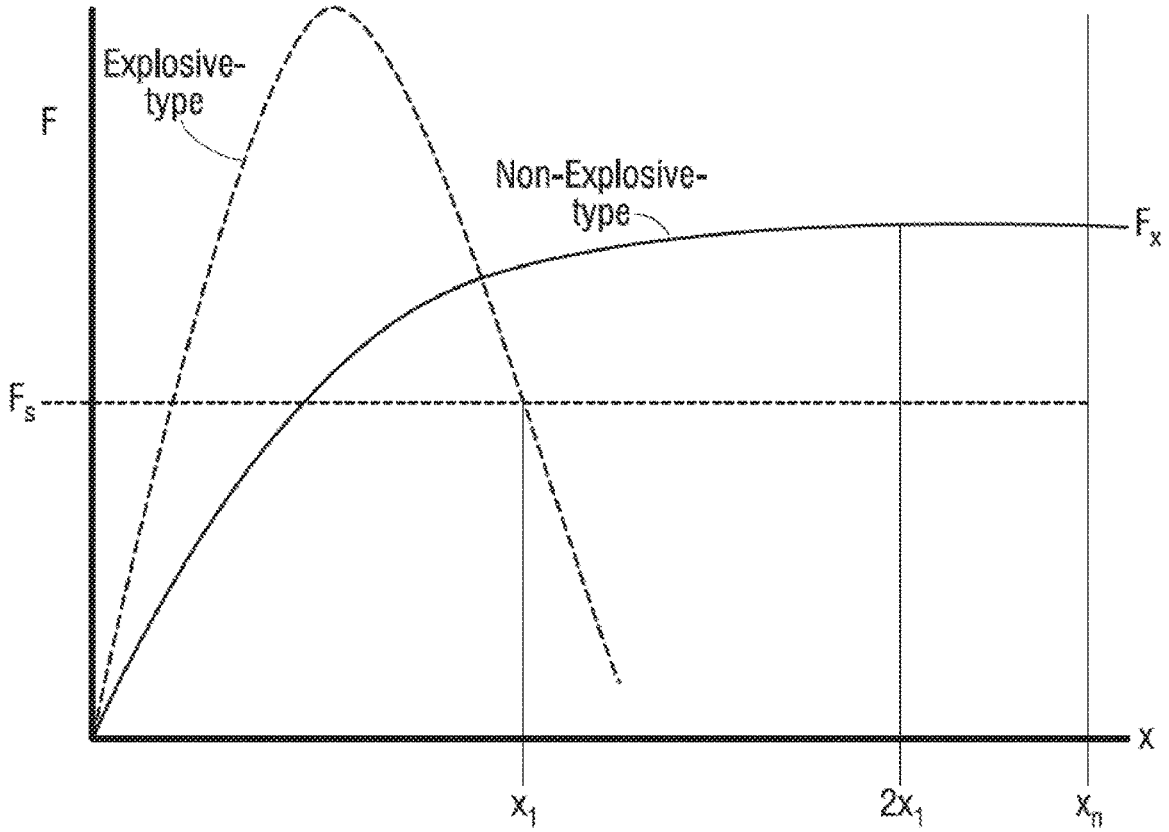
FIG. 7 illustrates a pressure curve for an explosive-type setting tool and a non-explosive gas-generating setting tool.

FIG. 7 compares the generated forces (F) for an explosive-type setting tool (dashed line) and a non-explosive gas-generating setting tool (solid lines) such as 300 (FIG. 3) as a function of stroke length (x). The tools depicted in FIG. 7 are both capable of delivering a shear force of Fs at a stroke length of $x_1$. In the following discussion, we will assume that $x_1$ is the rated stroke length, and Fs is the rated shear force at a particular hydrostatic pressure.

As shown in FIG. 7, the force delivered by the explosive-type setting tool falls off very quickly once the tool has stroked beyond its rated stroke length $x_1$. At a stroke length of twice the tool's rated stroke length (i.e., at $2x_1$), the explosive-type setting tool delivers essentially no force. By contrast, the non-explosive gas-generating setting tool delivers a substantial amount of force at a stroke length of $2x_1$. A characteristic of the non-explosive gas-generating setting tools described herein is that they can deliver a substantial fraction of their rated shear force at stroke lengths beyond their rated stroke length. Moreover, pressures provided by such tools preferably comprise at least 100%, 90%, 80%, 70%, 60% or 50% of their rated force at various multiples (one, two, three, etc.) of the standard stroke length.

The value $x_n$ in FIG. 7 is referred to as the maximum stroke length and may comprise the total distance crosslink keys 208 and 312 can travel before they reach a mechanical stop within tools 200 and 300, which is generally determined by the lengths of the tool body 307 and mandrel 311. As shown in FIG. 7, the non-explosive gas generating setting tool also supplies a greater amount of force over a greater percentage of the setting tool's maximum stroke length. According to certain embodiments, the non-explosive gas-generating setting tool may be capable of delivering at least about 75% of its maximum force at the maximum stroke length. According to still other embodiments, the non-explosive gas-generating setting tool may be capable of delivering at least about 85% of its maximum force at the maximum stroke length. According to still other embodiments, the non-explosive gas-generating setting tool may be capable of delivering at least about 95% of its maximum force at the maximum stroke length.

Figure 8:
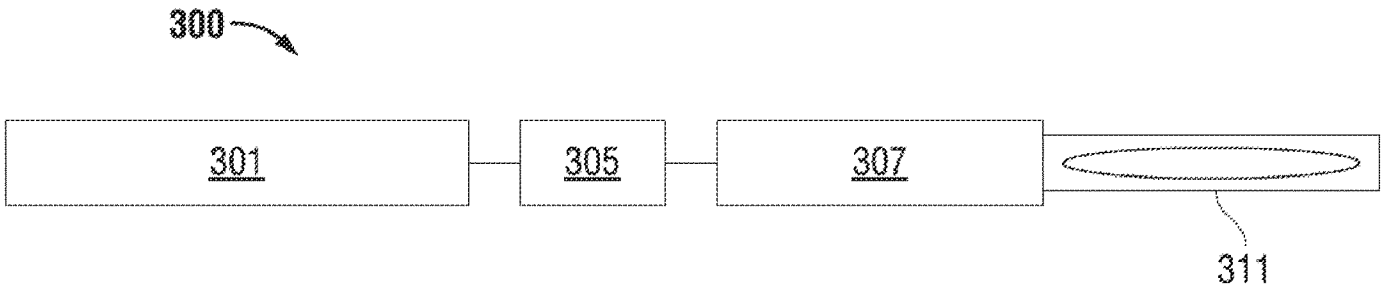
FIG. 8 illustrates embodiments of a non-explosive gas-generating fuel.

The ability to apply useful force over greater distances (greater standard stroke lengths) is advantageous because it significantly increases the versatility of the setting tool. FIG. 8 is a schematic illustration of the major sections of a non-explosive gas-generating setting tool 300, including the power stick body 301, bleed sub 305, tool body 307 and mandrel 311. Because the force generated by the non-explosive power stick (i.e., power source) 302 in the power stick body 301 is effective over a range of distances, that same power stick 302 can be used with different sizes of tool bodies 307 and mandrels 311, thereby providing different maximum stroke lengths, $x_n$, and different standard stroke lengths depending on the hydrostatic pressures at which it will be used. The non-explosive gas-generating setting tool 300 described herein can thus be provided as a modular kit containing a single (or limited number of) power source bodies 301, and a variety of sizes of tool bodies 307 and mandrels 308. Table 1 provides examples of modular tool combinations for providing different stroke lengths (metric values approximate).

TABLE 1

Modular Setting Tool Component Combinations.

| Power source Body 301 | Mandrel 311 | Rated Stroke Length | Maximum Stroke Length |
|---|---|---|---|
| 40 cm (16 in) | 40 cm (16 in) | 30 cm (12 in) | 40 cm (16 in) |
| 40 cm (16 in) | 70 cm (28 in) | 60 cm (24 in) | 70 cm (28 in) |
| 40 cm (16 in) or 70 cm (28 in) | 130 cm (52 in) | 120 cm (48 in) | 130 cm (52 in) |

The non-explosive gas-generating setting tool, because of its force curve as illustrated in FIG. 7, affords another advantage over explosive-type tools because its force is delivered in a controlled manner and not as an abrupt impulse. Such controlled delivery makes that force more useful. For example, a downhole tool 100 may be misaligned within the wellbore 101. If force is explosively delivered to the downhole tool (as illustrated in the dashed line of FIG. 7) when the downhole tool 100 is misaligned, the downhole tool may not seat properly, or worse yet, may seriously damage the wellbore 101. In contrast, force delivered non-explosively (as illustrated by the solid line of FIG. 7) can controllably push the downhole tool into alignment and then continue to apply pressure to set the downhole tool. In this regards, and while depending on the hydrostatic pressure, note that the stroke of the non-explosive gas generating setting tool can occur and provide useful force over a time period of several seconds to greater than a minute.

Moreover, some downhole tools benefit when setting pressure is sustained or increased during the stroke of the non-explosive gas generating setting tool. Referring again to the downhole tool illustrated in FIG. 1, setting of the downhole tool may be considered to proceed in stages. For example, the first stage may be the upward motion causing slips (i.e., dogs) 112 to grip an ID 103 of the wellbore and provide static purchase. The second stage may be compressing the sealing section 107 to form a seal with the ID 103. The third stage may be further compression, causing the slips 115 to bite into the ID 103. The fourth stage may be the shearing of the shear stud (not shown) to release the setting tool from the downhole tool.

The explosive application of pressure (as illustrated by the dashed line of FIG. 7) will simply "blow through" each of these stages, potentially leaving one or more of them incomplete and resulting on the shearing of the shear stud before the downhole tool is properly set. The non-explosive application of pressure (as illustrated by the solid line of FIG. 7), however, provides adequate time for each of the setting stages to complete in a sequential or cascading manner, resulting in optimum setting of the downhole tool.

The ability to deliver pressure in a sustained and/or increasing manner is due to the non-explosive generation of gas and also to the controlled rate at which that gas is produced. The gas production rate is a function of the burn rate of the material in the power source 302, which in turn is a function of the pressure within the power source body 301, as well as other factors, including temperature and the power source geometry (i.e., the burning surface area). To provide controllable increasing pressure, it can be beneficial to minimize changes in the variables that affect the burn rate so that the pressure within the power source body 301 is the primary determinant of the burn rate.

Figure 9F:
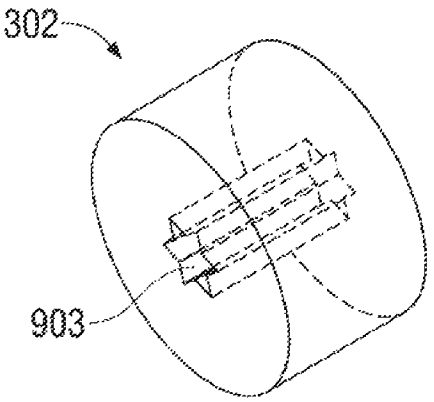
FIGS. 9A to 9F are schematic illustrations of modular non-explosive gas-generating setting tools.
Figure 9C:
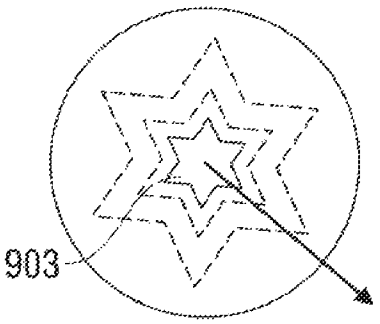
Figure 9E:
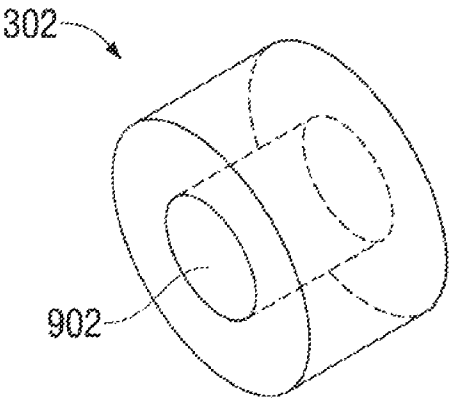
Figure 9B:
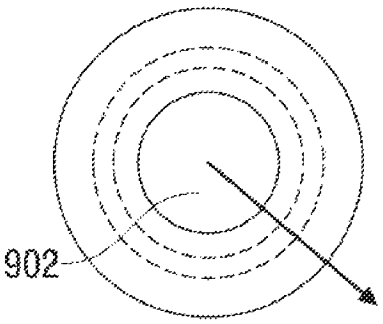
Figure 9D:
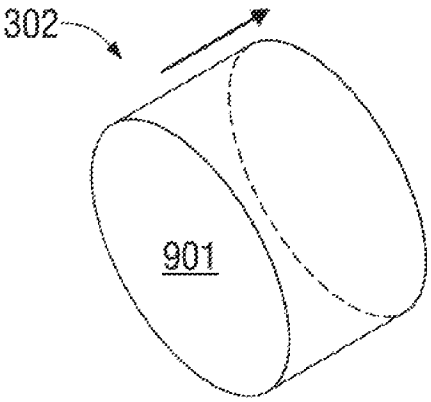
Figure 9A:
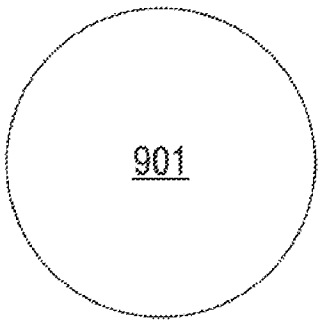

One way of minimizing changes in the burn rate due to changes in the burning surface area of the power source is to optimize the power source geometry so that the burning surface remains constant. FIGS. 9A to 9F illustrates three possible power source 302 geometries. FIGS. 9A and 9D depict a simple cylinder, wherein burning proceeds from face 901 and burns along the cylinder, as indicated. The burning surface area 901 remains relatively constant as burning proceeds. Therefore, the geometry-dependence of burning rate is minimized with the geometry illustrated in FIGS. 9A and 9D. The power source, illustrated in FIGS. 9B and 9E, is provided with a hollow cylinder 902. Burning thus proceeds from inside out, as illustrated by the concentric circles of FIGS. 9B and 9E. As burning proceeds, the burning surface area, and hence the burn rate, increases. Likewise, the power source, illustrated in FIGS. 9C and 9F, is provided with a star-shaped cavity 903 running down its length. Burning proceeds from the inside out with the surface area increasing at an even greater rate than in the embodiment illustrated in FIGS. 9B and 9E. Thus, the burn rate of the power source, illustrated in FIGS. 9C and 9F, will increase most rapidly as a function of geometry as burning progresses, irrespective of changes in pressure. The geometry, illustrated in FIGS. 9A and 9D, should be used to have pressure within the power source body 301 as the primary determinant of the burn rate.

According to certain embodiments of the non-explosive gas-generating setting tools 300 described herein, a power source 302 having a cylindrical geometry, as illustrated in FIGS. 9A and 9D, is provided as a fuel source. Such a power source may have a burn rate that is related to the pressure within power source body 301 according to the formula:

$$r=r_o+aP_c^n$$

wherein r is the burn rate, $r_o$ is typically 0, a and n are empirically determined constants, and Pc is the pressure within power source body 301.

Consider the multi-staged sequence described above for deploying a downhole tool. When the power source 302 is activated and the piston 306 and shaft 309 begin to stroke, the volume of power source body 301 expands against a pressure that is primarily determined by the hydrostatic pressure at the downhole position of the setting tool. As the first stage of tool setting is encountered (e.g., setting the bottom slips into the ID of the wellbore), the power source body 301 volume expansion will meet with the additional pressure needed to complete that stage. The burn rate of the power source therefore increases. Once the first stage is completed, the stroke will continue and the power source body volume will continue to expand until the second stage (e.g., compressing the sealing section) is encountered. Again, the burn rate of the power source will increase under the influence of the additional pressure. As each new pressure demand is placed on the non-explosive gas-generating setting tool, the burn rate of the power source increases to compensate for that demand.

Figure 10:
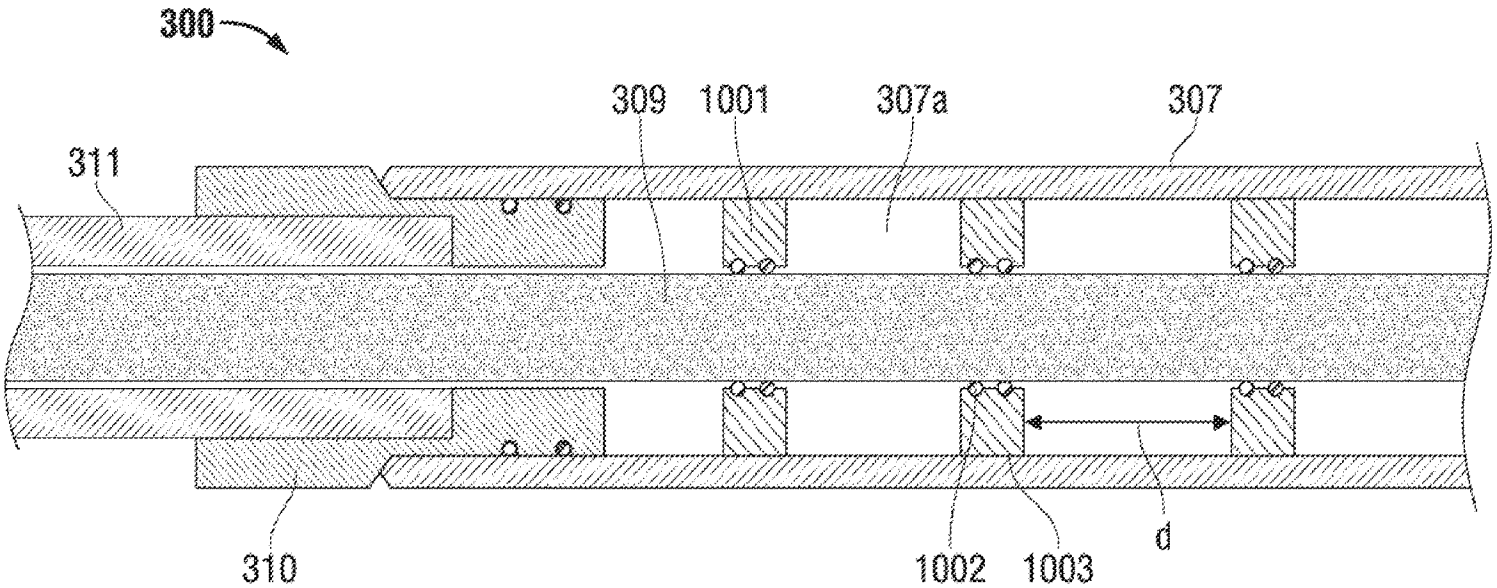
FIG. 10 illustrates a non-explosive gas-generating setting tool containing lateral support members to prevent the tool's shaft from buckling.

As the stroke length and/or the force applied over the stroke length increases, a potential mode of tool failure is a buckling of the shaft 309. To prevent such failure, also known as Euler failure, the non-explosive gas-generating setting tool can be configured with lateral supports 1001 within the tool body chamber 307*a* to prevent the shaft 309 from buckling, as shown in FIG. 10. The lateral support members 1001 can include o-rings 1002, which form a seal with the shaft 309. The interface 1003 between the lateral support members and the ID of the tool body 307 generally allows lateral support members 1001 to move axially as shaft 309 strokes downward. As shaft 309 strokes, lateral support members 1001 will sequentially come to rest against shaft sub 310. Thus, the lateral support members 1001 reduce the unsupported length of shaft 309 to a value d, which is substantially shorter than the entire length of shaft 309, thereby significantly increasing the amount of vertical load that shaft 309 can handle before buckling.

The setting tools described herein can be provided in a variety of outside diameters to fit within a variety of tubular members. Typical diameters can range from about 2 cm (0.75 inches) to about 15 cm (6 inches), or greater.

The foregoing disclosure and the showings made of the drawings are merely illustrative of the principles of this invention and are not to be interpreted in a limiting sense.

The invention claimed is:

1. A setting tool, comprising:

a tool body coupled to a well tool configured to be deployed downhole within a well;

a chamber within the tool body configured to contain a non-explosive fuel configured to be initiated to generate gas and plasma;

a cavity within the tool body;

a bleed sub located within the tool body between the chamber and the cavity, wherein the bleed sub is configured to bleed pressure from the chamber to the cavity after the non-explosive fuel has been initiated;

a piston disposed within the cavity and oriented to stroke in a first direction in response to a pressure increase in the cavity after the non-explosive fuel has been initiated, wherein the piston divides the cavity into an upper volume and a lower volume, and wherein the upper volume receives the pressure increase from the bleed sub; and a shaft mechanically connected to the piston within the lower volume of the cavity and configured to stroke with the piston, wherein the shaft comprises a dampening conduit configured to decelerate the stroke of the piston by draining a fluid from the lower volume after the non-explosive fuel has been initiated.

2. The well tool of claim 1, wherein the dampening conduit is configured to drain the fluid to a location that is external to the tool body.

3. The well tool of claim 1, wherein the fluid comprises oil, an oil derivative, or a synthetic lubricant.

4. The well tool of claim 3, wherein the fluid is at least one of non-flammable, not-toxic, and non-corrosive.

5. The well tool of claim 3, wherein the fluid reduces a rate of travel of the piston during the stroke to be within. a range of 0.25 inches per second to 10 inches per second.

6. The well tool of claim 1, wherein the dampening conduit comprises an inlet hole and an outlet hole, wherein the inlet hole and the outlet hole are adjustable to change flow of the fluid through the dampening conduit.

7. The well tool of claim 1, wherein the dampening conduit comprises an inlet hole in the shaft that is between 1 cm and 3 cm from the piston.

8. The well tool of claim 1, further comprising a snubber within the tool body configured to decelerate the piston and the shaft as the piston completes the stroke in the first direction.

9. The well tool of claim 1, wherein the dampening conduit is shaped to slow the flow of the fluid, and to slow the stroke of the piston in the first direction.

10. The well tool of claim 1, wherein the tool body comprises a first inside diameter, and wherein one or more 0-rings disposed upon the piston form a gas-tight seal between the piston and the first inside diameter.

11. The well tool of claim 10, further comprising a second inside diameter longitudinally disposed with respect to the first inside diameter, wherein the second inside diameter is greater than the first inside diameter.

12. The well tool of claim 11, wherein the piston strokes in the first direction from the first inside diameter to the second inside diameter, and wherein the one or more o-rings do not form a gas-tight seal between the piston and the second inside diameter.

13. A method of setting a setting tool, comprising:

activating a power source to generate a source of expanding gases within a first cavity;

expanding the expanding gases through a bleed sub to a second cavity;

stroking a piston through the second cavity with the expanding gases; and decelerating the piston before the piston completes a stroke length, wherein decelerating the piston comprises forcing fluid through a dampening conduit within a shaft of the setting tool, wherein the shaft is attached to, and strokes with, the piston.

14. The method of claim 13, comprising bleeding the expanding gases to an external area of the setting tool.

15. The method of claim 14, wherein bleeding the expanding gases comprises releasing a gas-tight seal between the piston and an inner diameter of the setting tool.

16. The method of claim 13, comprising setting a downhole tool, wherein the downhole tool comprises a packer, a bridge plug, a fracturing plug, or any combinations thereof.

17. The method of claim 13, comprising filtering the expanding gases through a filtering plug, wherein the filtering plug is configured to filter solid particulates that are produced by the power source.

18. The method of claim 13, wherein stroking the piston comprises pushing a crosslink key with a shaft.

19. The method of claim 13, wherein decelerating the piston further comprises deforming a snubber.

* * * * *